US012129146B2

(12) United States Patent
Moore et al.

(10) Patent No.: US 12,129,146 B2
(45) Date of Patent: Oct. 29, 2024

(54) SHEET PATH INTERSECTION DEVICE

(71) Applicant: Xerox Corporation, Norwalk, CT (US)

(72) Inventors: Steven R. Moore, Rochester, NY (US); Richard R. Getz, Sr., Fairport, NY (US); James M. Maryniak, Webster, NY (US); Patrick Darby, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 151 days.

(21) Appl. No.: 17/856,159

(22) Filed: Jul. 1, 2022

(65) Prior Publication Data

US 2024/0002179 A1 Jan. 4, 2024

(51) Int. Cl.
*B65H 5/20* (2006.01)
*B65H 5/06* (2006.01)

(52) U.S. Cl.
CPC ..... *B65H 5/20* (2013.01); *B65H 5/062* (2013.01); *B65H 2403/55* (2013.01); *B65H 2513/42* (2013.01)

(58) Field of Classification Search
CPC ..... B65H 5/20; B65H 5/062; B65H 2403/55; B65H 2513/42
USPC ..... 271/272–274
See application file for complete search history.

(56) References Cited

U.S. PATENT DOCUMENTS 4,750,853 A * 6/1988 Van Soest ..... B65H 31/3027 271/220
5,842,692 A * 12/1998 Rutishauser ..... B41J 29/13 271/3.2
6,259,888 B1 * 7/2001 Kazama ..... B65H 29/12 271/183
6,336,629 B1 * 1/2002 Carter ..... G03G 15/6529 384/581
7,252,287 B2 * 8/2007 Tsutoh ..... B65H 5/062 271/274
7,427,065 B2 * 9/2008 Maruyama ..... B65H 5/062 271/274
8,185,038 B2 * 5/2012 Eda ..... B65H 37/00 271/209
8,910,940 B2 * 12/2014 Isohara ..... G03G 21/1695 271/9.12
2001/0017438 A1 * 8/2001 Takamtsu ..... H04N 1/0058 271/3.14

* cited by examiner

*Primary Examiner* — Thomas A Morrison
(74) *Attorney, Agent, or Firm* — Gibb IP Law Firm, LLC

(57) ABSTRACT

Apparatuses include, among other components, a pair of opposing drive rollers, a pair of opposing idle rollers, and a rotatable support operatively connected to the axles of the idle rollers. Axles of the drive rollers and the idle rollers are positioned along a circle. The axles of the drive rollers and the idle rollers alternate along the circle. Also, rotation of the rotatable support moves the idle rollers along the circle until the idle rollers contact the drive rollers. Each of the idle rollers is positioned by the rotatable support to only contact a single drive roller at a time.

17 Claims, 12 Drawing Sheets

SHEET PATH INTERSECTION DEVICE

BACKGROUND

Systems and methods herein generally relate to apparatuses that move sheets along sheet paths and more particularly to devices useful at intersections of sheet paths.

The more compact that a sheet transport device can be made produces advantages including weight reduction, lower cost, reduced area requirements, etc. In one example, some sheet transport devices handle oversized and overlength sheets. Such devices end up having an increased size that can decrease user satisfaction.

SUMMARY

Various apparatuses herein include, among other components, a pair of opposing drive rollers, a pair of opposing idle rollers, and a rotatable support operatively connected to the axles of the idle rollers. Axles of the drive rollers and the idle rollers are positioned along a circle. The axles of the drive rollers and the idle rollers alternate along the circle. Also, rotation of the rotatable support moves the idle rollers along the circle until the idle rollers contact the drive rollers. Each of the idle rollers is positioned by the rotatable support to only contact a single drive roller at a time.

Additional apparatuses herein include, among other components, a frame, drive rollers operatively connected to the frame, a rotatable support operatively connected to the frame, idle rollers operatively connected to the rotatable support. The drive rollers and the idle rollers lie in the same plane. A pivot axis of the rotatable support is centered between axles of the drive rollers and is also centered between axles of the idle rollers. The axles of the drive rollers are in a fixed position relative to the frame and the axles of the idle rollers move relative to the drive rollers as the rotatable support rotates.

Additional embodiments herein include a sheet transport device. Such a device includes, among other components, a frame, sheet transport paths operatively connected to the frame, and a path intersection nip driver positioned at an intersection of two of the sheet transport paths.

The path intersection nip driver includes, among other components, drive rollers operatively connected to the frame, a rotatable support operatively connected to the frame, and idle rollers operatively connected to the rotatable support. The drive rollers and the idle rollers lie in the same plane. A pivot axis of the rotatable support is centered between axles of the drive rollers and centered between axles of the idle rollers. The axles of the drive rollers are in a fixed position relative to the frame and the axles of the idle rollers move relative to the drive rollers as the rotatable support rotates.

More specifically, rotation of the rotatable support in a first direction relative to the frame causes a first idle roller to contact a first drive roller and a second idle roller to contact a second drive roller. Conversely, rotation of the rotatable support in a second direction (opposite the first direction) causes the first idle roller to contact the second drive roller and the second idle roller to contact the first drive roller. The first idle roller spins in opposite directions when contacting either the first drive roller or the second drive roller, and the second idle roller similarly spins in opposite directions when contacting either the first drive roller or the second drive roller.

Also, contact between the first idle roller and the first drive roller forms a first drive nip. Contact between the second idle roller and the second drive roller forms a second drive nip. Contact between the first idle roller and the second drive roller forms a third drive nip. Contact between the second idle roller and the first drive roller forms a fourth drive nip. The first drive nip and the second drive nip form a first sheet path and the third drive nip and the fourth drive nip form a second sheet path. The first sheet path intersects the second sheet path. Additionally, the pivot axis of the rotatable support is aligned with a sheet path intersection location where the first sheet path intersects the second sheet path.

Such devices also include at least one drive motor operatively connected to the frame. The drive rollers are connected to the drive motor to continuously rotate in opposite directions. Also included is a rotation motor operatively connected to the frame. The rotatable support is connected to the rotation motor to pivot about the pivot axis upon operation of the rotation motor. The rotation motor is adapted to alternatively rotate the rotatable support in either a clockwise direction or a counter-clockwise direction.

These and other features are described in, or are apparent from, the following detailed description.

BRIEF DESCRIPTION OF THE DRAWINGS

Various exemplary systems and methods are described in detail below, with reference to the attached drawings, in which.

DETAILED DESCRIPTION

As mentioned above, reducing the size of a sheet transport device can produce a number of advantages, including weight reduction, lower cost, reduced area requirements, etc. Some devices temporarily extend sheet paths outside their normal locations when accommodating extra-large sheets. However, sheet paths can be made to curve within sheet transport devices to increase the length of the sheet path and correspondingly increase the sheet size that can be accommodated without increasing the exterior size of the sheet transport devices.

Additionally, utilizing intersecting paper paths helps increase the sheet size that can be accommodated without increasing overall device size. One issue with some sheet intersection devices is that they can be unreliable and can result in an unacceptably high rate of sheet jams. Alternative intersection designs can reduce the probability of sheet jams; however, such devices are more complex, which renders such complex devices more expensive and more vulnerable to component failure.

In view of such issues, the systems and methods herein provide sheet path intersection devices that use a simplified structure with a very low sheet jam rate to promote a compact structure. Some devices herein use two fixed-position drive shafts connected to drive rollers in combination with two movable idler shafts connected to idler rollers. The idler shafts are joined together so that they pivot about the center of the sheet intersection. An actuator moves the idler shafts into multiple positions, which allows two drive nips to be formed to drive sheets through the intersection in either of two directions. This provides a simplified, compact architecture that easily switches between different sheet paths without sheet jams.

Figure 1:
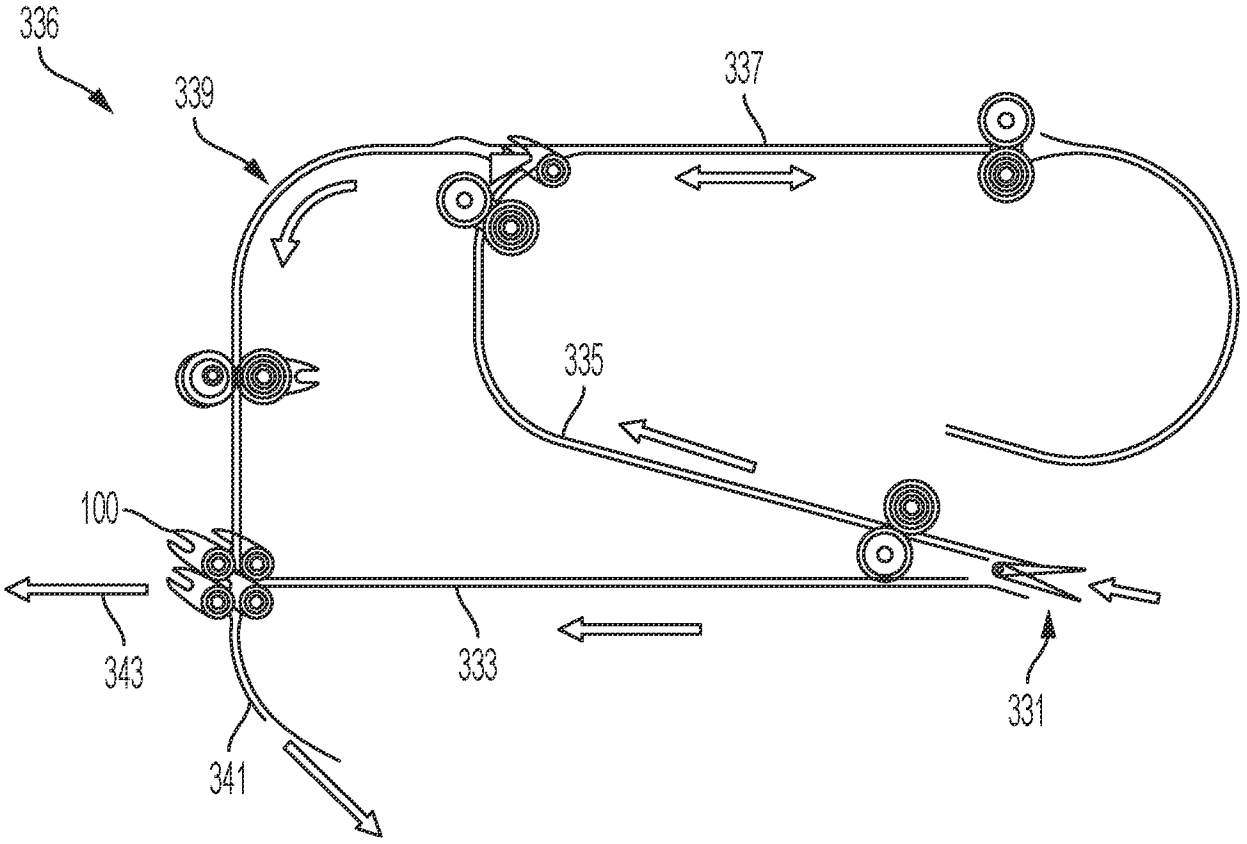
FIG. 1 is a conceptual diagram illustrating a sheet transportation device herein.

FIG. 1 illustrates an example of a sheet transport device 336 that performs the function of duplexing. Specifically, the structure 336 shown in FIG. 1 receives sheets (for example, sheets of print media) into an input 331. The input 331 directs the sheets to a pass-through sheet path 333 or to a sheet reversal (sheet flipping) path 335. Sheets directed to the pass-through sheet path 333 pass through a path intersection nip driver 100 to an exit 343. In one example, sheets that have received printing on both sides can utilize the pass-through sheet path 333.

Sheets directed to the sheet reversal path 335 are generally sheets that have received printing or other processing on one side and such sheets pass into a long curved reversal path portion 337. The sheets stop and reverse direction and are directed to an exit path 339 and out a duplex exit 341. The process of reversing the sheets and directing the sheets along the exit path 339 flips the sheets. The duplexed (flipped) sheets exiting the duplex exit 341 are returned to the printer to allow printing on the other side of the sheets.

For certain applications, for instance ballot printing, it is desired to print in duplex mode on sheets significantly longer than standard (e.g., 14 inches long or longer). The reversal path portion 337 and exit path 339 shown in FIG. 1 is relatively longer than duplex paths of standard duplexing devices to accommodate such extra-long sheets.

In order to accommodate for the added length of the reversal path portion 337 and exit path 339 without increasing the overall dimensions of the sheet transport device 336 or using exterior sheet path extensions, the sheet paths 333 and 339 intersect at the path intersection nip driver 100. As noted above, the path intersection nip driver 100 uses two fixed-position drive shafts connected to drive rollers in combination with two movable idler shafts connected to idler rollers. The idler shafts are joined together so that they pivot about the center of the intersection. An actuator moves the idler shafts into multiple positions, which allows two drive nips to be formed to drive sheets through the intersection in either of two directions.

While driven rollers are shown in the examples below, with path intersection nips herein, the four rollers shown at the intersection can all be idler rolls, such that they freewheel (freely spin on their axles) when a sheet of paper driven by an upstream nip driver directs a sheet through the intersection. In some examples discussed below, two of the rollers are driven at a commanded velocity to ensure a continuous drive force acting on the sheet throughout its passage through the path intersection.

Figure 2A:
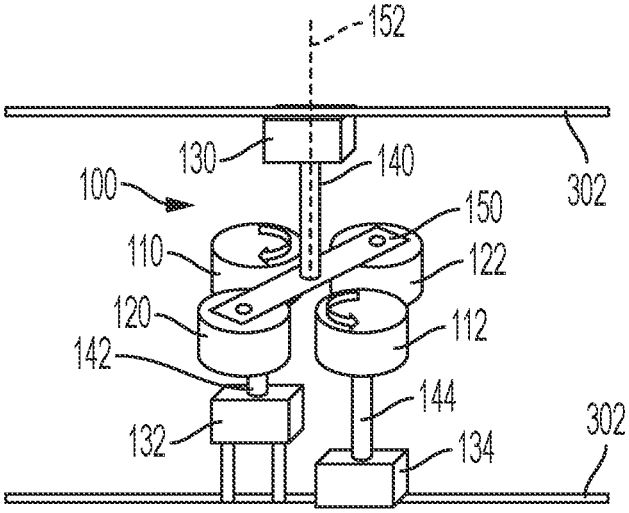
FIG. 2A is a conceptual perspective diagram illustrating a sheet path intersection device herein.

FIG. 2A shows one example of a path intersection nip driver 100 herein that includes drive motors 132, 134 connected to a device frame 302. Note that, in some drawings herein, items are similarly connected to the device frame 302; however, the illustration of the device frame 302 is omitted from some drawings in order to reduce clutter in the drawings and to allow the salient features of the embodiments herein to be more easily seen and understood.

FIG. 2A additionally show that the drive motors 132, 134 are connected to drive rollers 110, 112 by drive shafts 142, 144. A rotation motor 130 is also connected to the frame 302 and to a rotatable support 150 by way of a support shaft 140. The rotatable support 150 is connected to freewheeling idle rollers 120, 122.

Therefore, FIG. 2A illustrates an arrangement of four rollers 110, 112, 120, 122 that provides a selectable drive force to a sheet passing through the path intersection nip driver 100. Two of the rollers 120, 122 are located on shafts 142, 144 with fixed locations and are driven in the directions shown by the curved arrows. The other two rollers 110, 112 are idlers (free spinning, freewheeling, non-driven) and are located on a rotatable support 150 that can be rotated about a pivot axis 152 (where the rotatable support 150 connects to the support shaft 140) at the centerline of the intersection by the rotation motor or solenoid 130. The idler rollers 120, 122 are tied together by the rotatable support 150 and move together as an assembly.

Figure 2B:
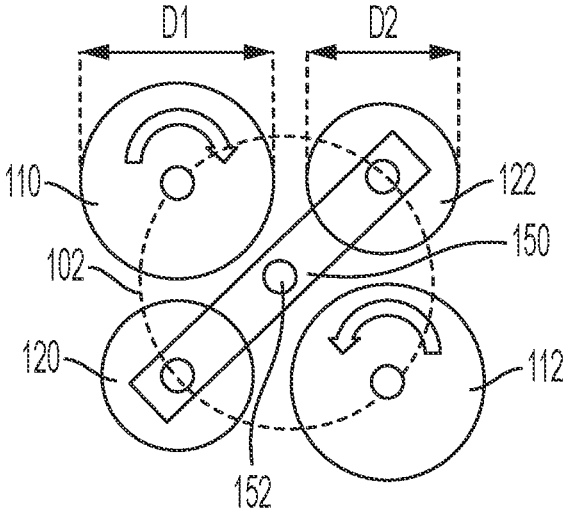
FIG. 2B is a conceptual plan view diagram illustrating a sheet path intersection device herein.

FIG. 2B illustrates the same structure shown in FIG. 2A, but in plan or top view with some items eliminated to simplify the illustration. Thus, again FIG. 2B illustrates a pair of opposing drive rollers 110, 112, a pair of opposing idle rollers 120, 122, and a rotatable support 150 operatively connected to the axles of the idle rollers 120, 122. FIG. 2B shows that the drive rollers 110, 112 and the idle rollers 120, 122 can be different sizes (have different diameters D1 and D2) to help refine the angle between the paper paths that intersect.

FIG. 2B shows that the axles of the drive rollers 110, 112 and the idle rollers 120, 122 are positioned along a circle 102 (location shown in dashed lines). The axles of the drive rollers 110, 112 and the idle rollers 120, 122 alternate along the circle 102. As shown in later drawings, rotation of the rotatable support 150 moves the idle rollers 120, 122 along the circle until the idle rollers 120, 122 contact the drive rollers 110, 112. Each of the idle rollers 120, 122 is positioned by the rotatable support 150 to only contact a single drive roller at a time. While a single circle 102 is illustrated, the movement path can also be described as an oval, arc, etc. In other embodiments herein, the drive rollers 110, 112 can be located on a first circle/oval of a first radius, and the idle rollers 120, 122 can be located on a second circle/oval of second radius, where the first and second circles/ovals are concentric to each other. Thus, the drive rollers 110, 112 and idle rollers 120, 122 do not need to all lie on the same circle/oval and could be on slightly different radius concentric circles/ovals.

As noted above, the structure also includes a rotation motor 130 operatively connected to the frame 302. The rotatable support 150 is connected to the rotation motor 130 to pivot about the pivot axis 152 upon operation of the rotation motor 130. The rotation motor 130 is adapted to alternatively rotate the rotatable support 150 in either a clockwise direction or a counter-clockwise direction.

FIGS. 2A-2B show that the drive rollers 110, 112 and the idle rollers 120, 122 lie in the same plane and that the drive rollers 110, 112 and the idle rollers 120, 122 alternate along the circle 102. Because the rotatable support 150 constrains the movement of the idle rollers 120, 122 to the circle and because the drive rollers 110, 112 and the idle rollers 120, 122 lie in the same plane and alternate, the idle rollers 120, 122 will contact the drive rollers 110, 112 when their axles move along the circle 102.

As shown in FIG. 2B, the pivot axis 152 of the rotatable support 150 is located where the support shaft 140 contacts the rotatable support 150, is centered between axles of the drive rollers 110, 112, and the pivot axis 152 is also centered between axles of the idle rollers 120, 122. The axles of the drive rollers 110, 112 are in a fixed position relative to the frame 302 and the axles of the idle rollers 120, 122 move relative to the drive rollers 110, 112 as the rotatable support 150 rotates.

Figure 3A:
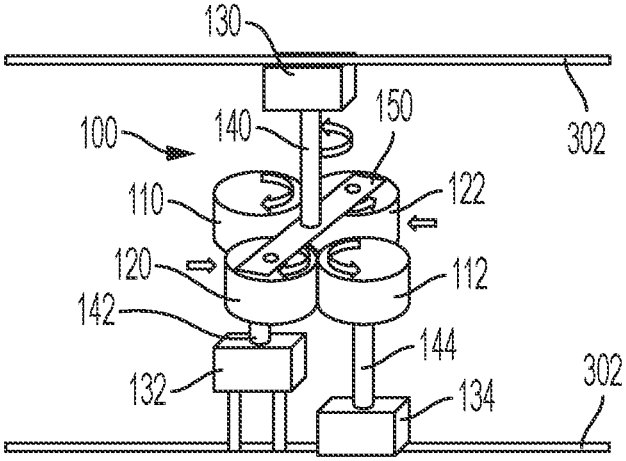
FIG. 3A is a conceptual perspective diagram illustrating a sheet path intersection device herein.
Figure 3B:
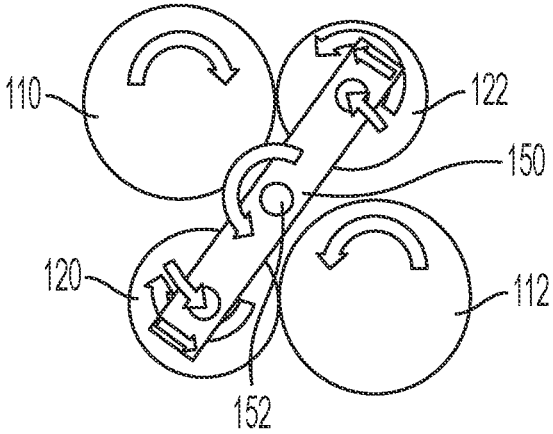
FIGS. 3B-3D are conceptual plan view diagrams illustrating a sheet path intersection device herein.
Figure 3C:
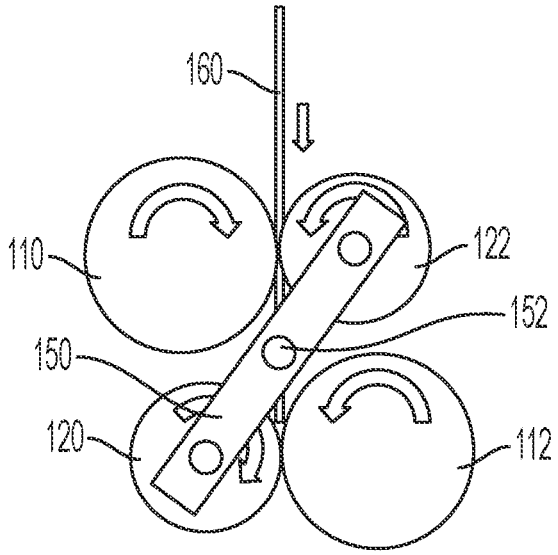
Figure 3D:
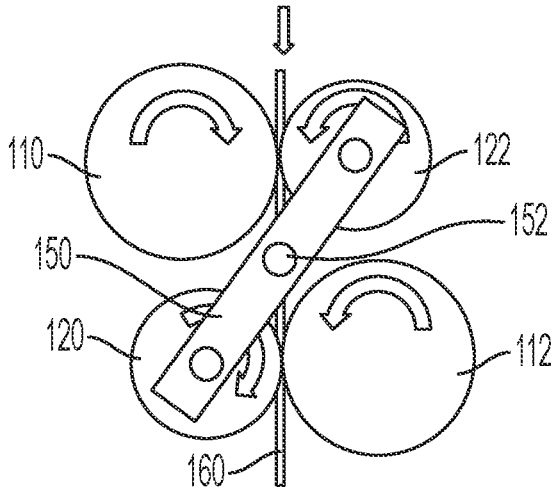
Figure 4A:
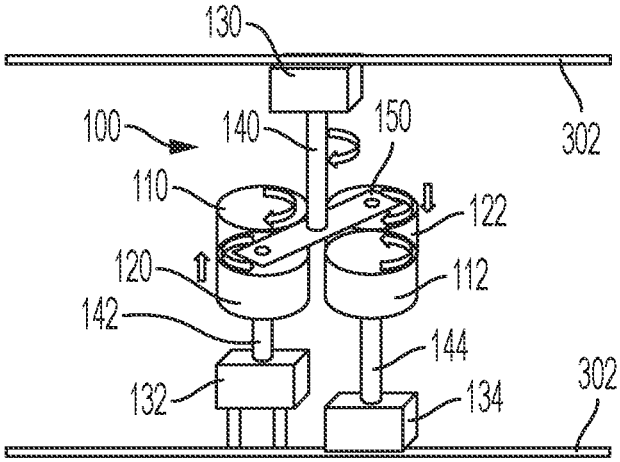
FIG. 4A is a conceptual perspective diagram illustrating a sheet path intersection device herein.

Moving to FIGS. 3A-4D, FIGS. 3A and 4A illustrate the same structure from the same viewpoint shown in FIG. 2A but with the rotatable support 150 rotated in the counter-clockwise direction (in the view shown in FIG. 3A) and the clockwise direction (in the view shown in FIG. 4A). FIGS. 3B-3D and 4B-4D illustrate the same structure from the same viewpoint shown in FIG. 2B but again with the rotatable support 150 rotated in the counterclockwise direction (in the view shown in FIGS. 3B-3D) and the clockwise direction (in the view shown in FIGS. 4B-4D).

Figure 4B:
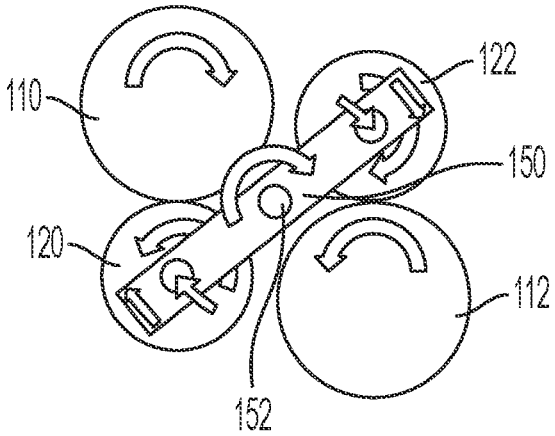
FIGS. 4B-4D are conceptual plan view diagrams illustrating a sheet path intersection device herein.

Specifically, as show in FIGS. 3A-3B, rotation of the rotatable support 150 in a first direction (in this example counterclockwise) relative to the drive rollers 110, 112 and frame 302 causes a first idle roller (e.g., 122) to contact a first drive roller (e.g., 110 and a second idle roller (e.g., 120) to contact a second drive roller (e.g., 112). Conversely, as shown in FIGS. 4A-4B, rotation of the rotatable support 150 in a second direction (opposite the first direction) causes the first idle roller 122 to contact the second drive roller 112 and the second idle roller 120 to contact the first drive roller 110. The first idle roller 122 spins in opposite directions when contacting the first drive roller 110 or the second drive roller 112, and the second idle roller 120 similarly spins in opposite directions when contacting the first drive roller 110 or the second drive roller 112.

Figure 4C:
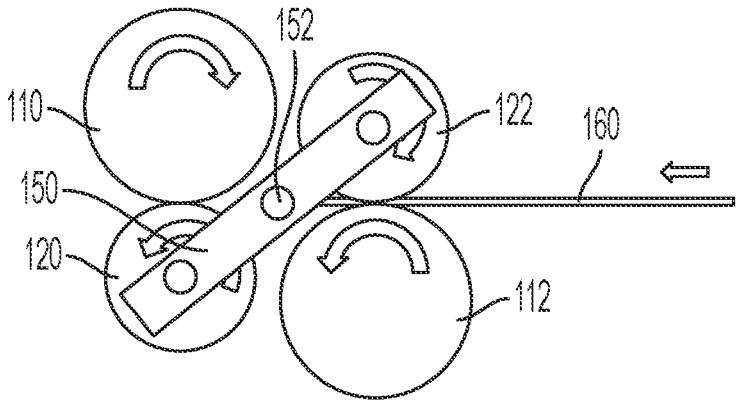
Figure 4D:
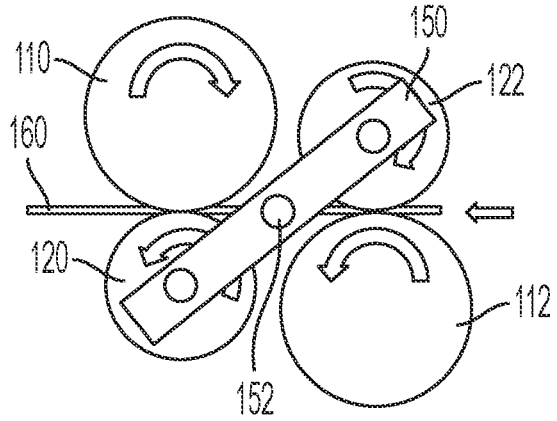

Also, as shown in FIGS. 3C-3D, contact between the first idle roller 122 and the first drive roller 110 forms a first drive nip; and contact between the second idle roller 120 and the second drive roller 112 forms a second drive nip. As shown in FIGS. 4C-4D, contact between the first idle roller 122 and the second drive roller 112 forms a third drive nip; and contact between the second idle roller 120 and the first drive roller 110 forms a fourth drive nip. The first drive nip and the second drive nip form a first sheet path that can move a sheet 160 in the direction the rollers rotate (shown by arrow in FIGS. 3C-3D) and the third drive nip and the fourth drive nip form a second sheet path that can move a sheet 160 in the direction the rollers rotate (shown by arrow in FIGS. 4C-4D).

In the example illustrated in FIGS. 3C-3D and 4C-4D, the first sheet path perpendicularly intersects the second sheet path. Additionally, the pivot axis 152 of the rotatable support 150 is aligned with the sheet path intersection location where the first sheet path intersects the second sheet path.

Figure 5:
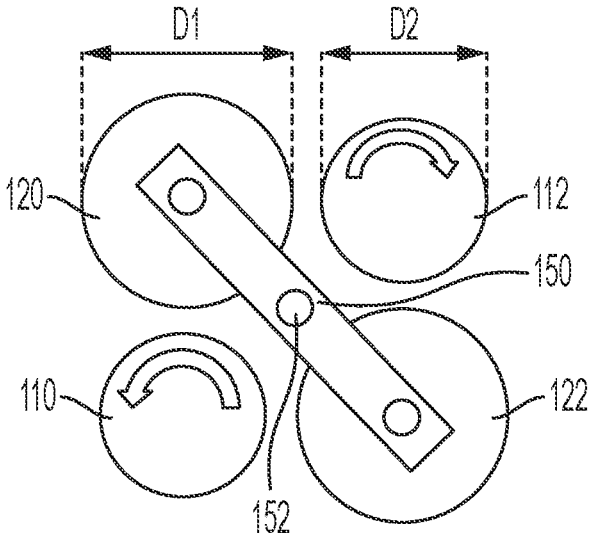
FIG. 5 is a conceptual plan view diagram illustrating a sheet path intersection device herein.
Figure 6A:
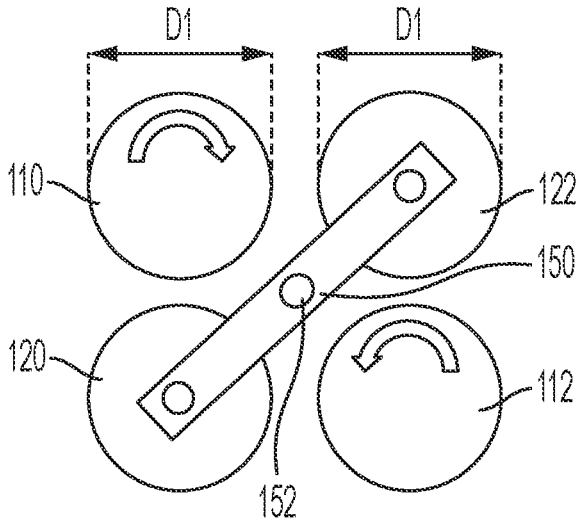
FIGS. 6A-6C are conceptual plan view diagrams illustrating a sheet path intersection device herein.

The discussion of FIG. 2B notes that the drive rollers 110, 112 and the idle rollers 120, 122 can be different sizes (have different diameters D1 and D2) with the drive rollers 110, 112 being larger than the idle rollers 120, 122. FIG. 5 illustrates that, with structures herein, the opposite can occur with the drive rollers 110, 112 being smaller (D2) than the idle rollers 120, 122 (D1). FIG. 6A illustrates that the drive rollers 110, 112 and the idle rollers 120, 122 can be the same size (D1) and FIGS. 6B-6D show the functional operation of a device that has the same sized drive rollers 110, 112 and the idle rollers 120, 122, as shown in FIG. 6A.

Figure 6B:
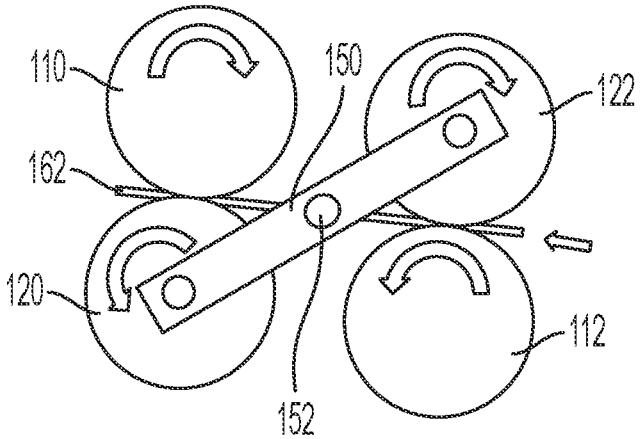
Figure 6C:
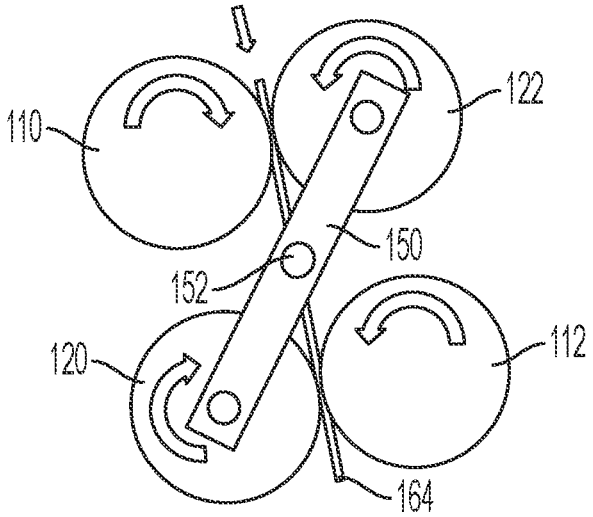
Figure 6D:
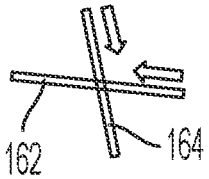
FIG. 6D is a conceptual diagram of intersecting sheet paths resulting from the structures shown in FIGS. 6A-6C.

Specifically, FIG. 6B shows that for a device that has the same sized drive rollers 110, 112 and the idle rollers 120, 122 (shown in FIG. 6A) when the rotatable support 150 is rotated in a first direction, a first paper path 162 is formed by the two nips between rollers 110-120 and 112-122. FIG. 6C shows that, for the same device, when the rotatable support 150 is rotated in a second direction that is opposite the first direction, a second paper path 164 is formed by the two nips between rollers 110-122 and 112-120. FIG. 6D shows that these two paths 162, 164 intersect in a non-perpendicular manner.

Figure 7:
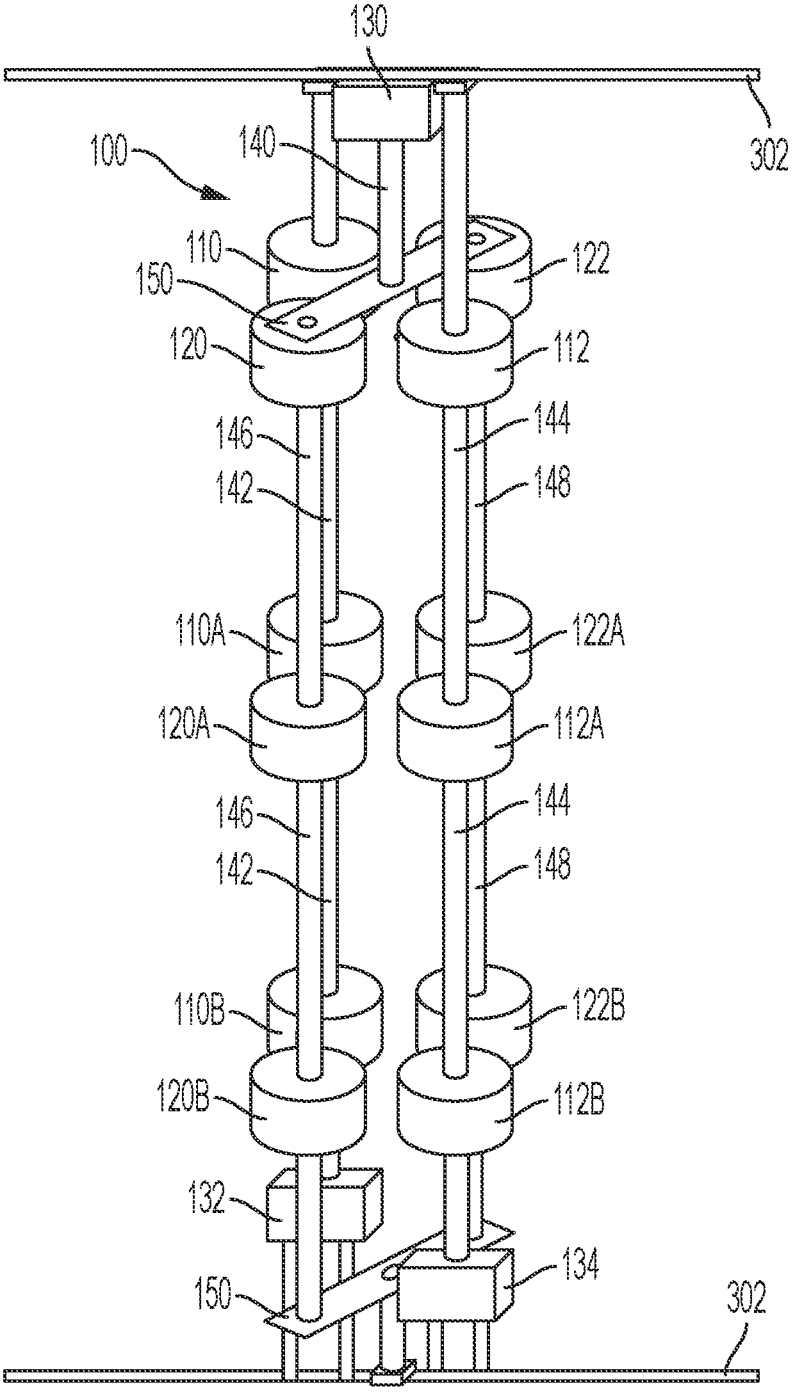
FIGS. 7 and 8 are conceptual plan view diagrams illustrating sheet path intersection devices herein.

FIG. 7 is a perspective view of a structure that is similar to the structure shown in FIG. 2A, except that in the structure shown in FIG. 7 idle shafts 146, 148 (connected to the idle rollers 120, 120A, 120B, 122, 122A, 122B and to two rotatable supports 150) are added and the drive shafts 142, 144 are relatively longer and are connected to more drive rollers 110A, 110B, 112A, 112B).

The idle shafts 146, 148 cause all the idle rollers 120, 120A, 120B, 122, 122A, 122B to move as the two rotatable supports 150 rotate. One of the rotatable supports 150 is connected to the rotation motor 130 through the rotation shaft 140 for the rotation. Each of the idle shafts 146, 148 contains at least two of the idle rollers 120 or 122. Similarly, each of the drive shafts 142, 144 contains at least two of the drive rollers 110 or 112.

In the structure shown in FIG. 7, three sets of the rollers (4 rollers per set: 2 idle rollers 120, 122 and two drive rollers 110, 112) are included; however, any number of sets of four rollers can be included in the devices herein, depending upon the width of the sheets passing through the path intersection drive nip structure. Thus, devices herein that provide the ability to handle wider sheets have longer shafts and more sets of four rollers.

Figure 8:
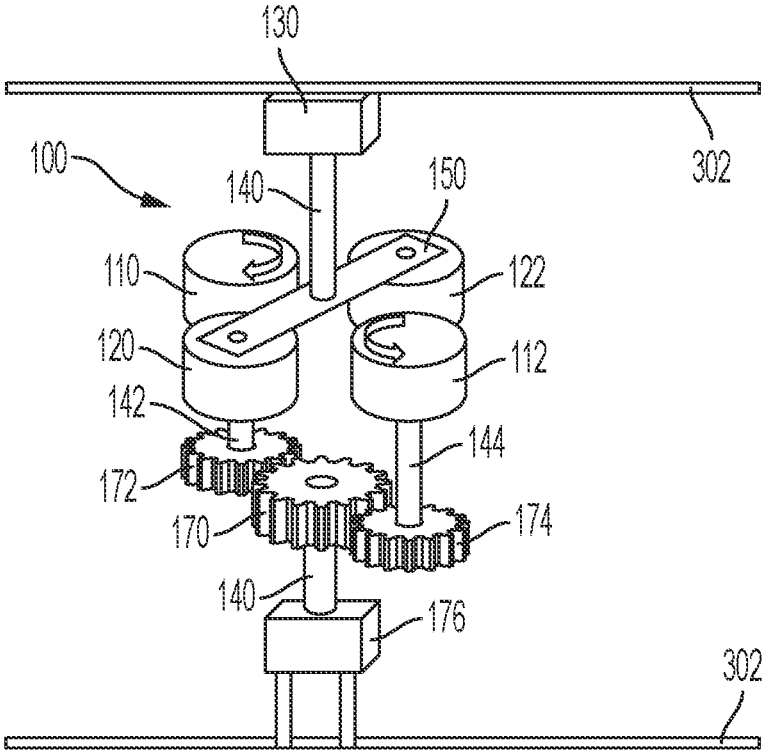

As noted above, such devices also include at least one drive motor 132, 134 operatively connected to the frame 302. In the examples above, the drive rollers 110, 112 are connected to two drive motors 132, 134. However, as shown in FIG. 8, a single motor 176 can be used to drive the drive rollers 110, 112. Specifically, because the drive rollers 110, 112 rotate in opposite directions, structures herein provide a gearset 170, 172, 174 impart drive torque from one shaft to the other. Specifically, the gear 170 converts the shaft 140 rotation into opposite rotations at gears 172, 174, which rotates the drive rollers 110, 112 to also have opposite rotations.

The above examples show how the idler assembly can be switched between two positions to provide the appropriate drive force to sheets traveling approximately perpendicular to each other (e.g., either vertically or horizontally). The idler assembly actuator can bias the idler assembly either clockwise or counter-clockwise, as needed. It is also possible to arrange the actuator to provide a third 'neutral' position in which there are no nips engaged. This could be used for improved jam clearance, for example. Therefore, these structures present a simple architecture to provide selectable drive force to sheets passing through a 4-way intersection and this enables highly compact and complex paper paths to be maintained within a compact exterior.

As noted above, these devices include (among other components) what is generically referred to herein as a "frame" 302. The frame 302 can comprise many different components of the apparatus, which are elements of the apparatus and which are directly or indirectly connected to each other. Thus, the frame herein can include any or all of the various elements that physically support the enumerated components discussed herein. In the attached drawings, identification numeral 302 is used to indicate the different items that can be considered to be this generically defined "frame." Relative to the device exterior, the frame is in a fixed location (even though many of the attached components move, rotate, etc., relative to the frame 302) and therefore all the following components are directly or indirectly connected to the frame 302 in some way.

Figure 9:
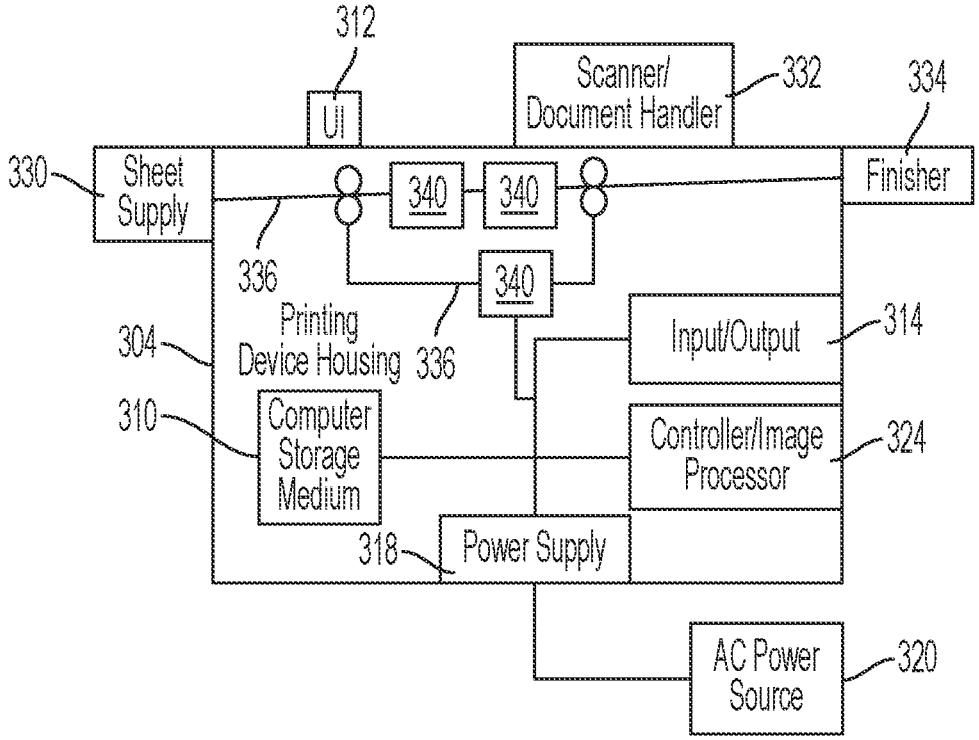
FIGS. 9-11 are conceptual diagrams illustrating sheet processing devices herein.

FIG. 9 illustrates a computerized device that is a printing device 304, which can be used with systems and methods herein and can comprise, for example, a printer, copier, multi-function machine, multi-function device (MFD), etc. In this structure a communications port (input/output) 314 is operatively connected to the tangible processor 324 and to a computerized network external to the computerized device 304. Also, the computerized device 304 can include at least one accessory functional component, such as a user interface (UI) assembly 312. The user may receive messages, instructions, and menu options from, and enter instructions through, the user interface or control panel 312.

The input/output device 314 is used for communications to and from the computerized device 304 and comprises a wired device or wireless device (of any form, whether currently known or developed in the future). The tangible processor 324 controls the various actions of the computerized device. A non-transitory, tangible, computer storage medium device 310 (which can be optical, magnetic, capacitor based, etc., and is different from a transitory signal) is readable by the tangible processor 324 and stores instructions that the tangible processor 324 executes to allow the computerized device to perform its various functions, such as those described herein. Thus, as shown in FIG. 9, a body housing has one or more functional components that operate on power supplied from an alternating current (AC) source 320 by the power supply 318. The power supply 318 can comprise a common power conversion unit, power storage element (e.g., a battery, etc), etc.

The printing device 304 includes at least one marking device (printing engine(s)) 340 operatively connected to a specialized image processor 324 (that is different from a general purpose computer because it is specialized for processing image data), a media path 336 positioned to supply continuous media or sheets of media from a sheet supply 330 to the marking device(s) 340, etc. After receiving various markings from the printing engine(s) 340, the sheets of media can optionally pass to a finisher 334 which can fold, staple, sort, etc., the various printed sheets. Also, the printing device 304 can include at least one accessory functional component (such as a scanner/document handler 332 (automatic document feeder (ADF)), etc.) that also operate on the power supplied from the external power source 320 (through the power supply 318).

Figure 10:
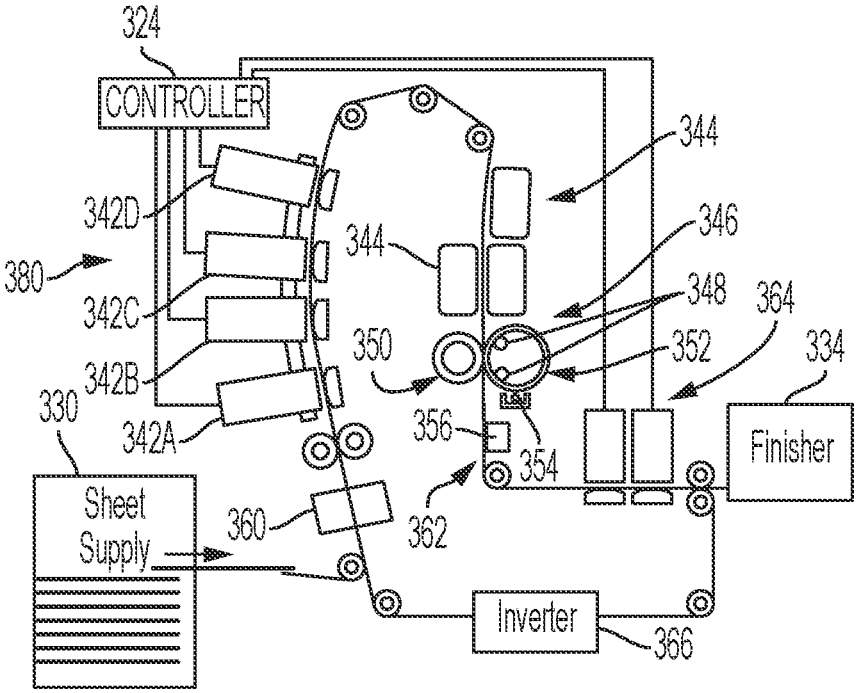
Figure 11:
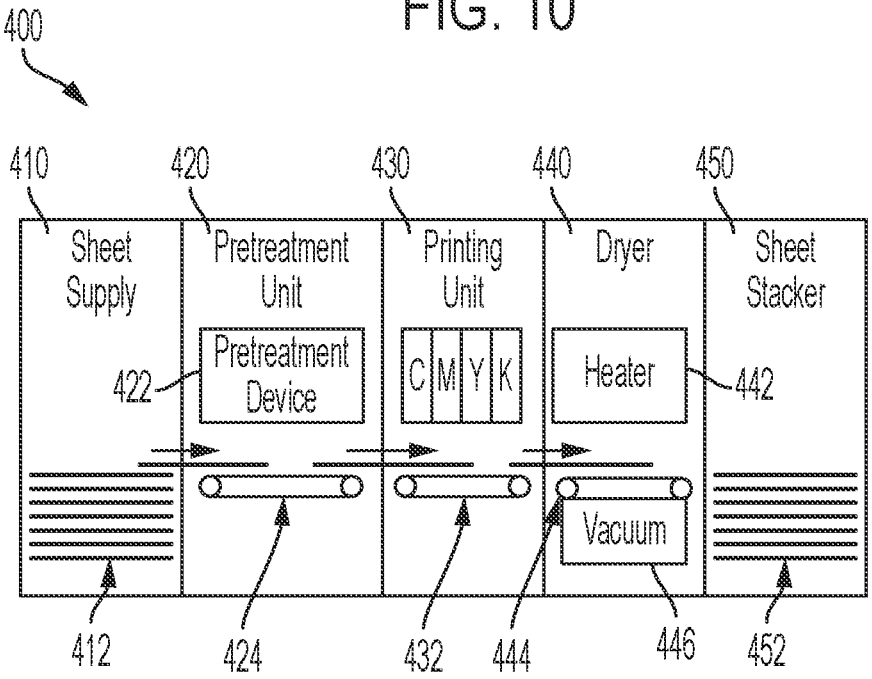

The one or more printing engines 340 are intended to illustrate any marking device that applies a marking material (toner, inks, etc.) to continuous media or sheets of media, whether currently known or developed in the future and can include, for example, devices that use an ink jet imaging system, as shown in FIG. 10, or a high-speed aqueous imaging system, as shown in FIG. 11.

More specifically, FIG. 10 illustrates one example of the above-mentioned printing engine(s) 380 that is an ink jet imaging system. In this example, the imaging apparatus 380 is in the form of an ink jet printer that employs one or more ink jet printheads, each with an associated solid ink supply (342A-342D). The exemplary direct-to-sheet phase-change ink jet imaging system 380 includes a media supply and handling system 330 configured to supply media (e.g., paper, plastic, or other printable material), a media conditioner 360, printed sheet conditioner 344, coating station 364, and finisher 334.

The media is propelled by a sheet transport 362 that can include a variety of motors rotating one or more rollers. For duplex operations, an inverter 366 may be used to flip the sheet over to present a second side of the media to the printheads 342A-342D.

The media conditioner 360 includes, for example, a pre-heater. The pre-heater brings the media to an initial predetermined temperature that is selected for desired image characteristics corresponding to the type of media being printed as well as the type, colors, and number of inks being used. The pre-heater may use contact, radiant, conductive, or convective heat to bring the media to a target preheat temperature.

The media is transported through a printing station that includes a series of color printheads 342A-342D, each color unit effectively extending across the width of the media and being able to place ink directly (i.e., without use of an intermediate or offset member) onto the moving media. As is generally familiar, each of the printheads may eject a single color of ink, one for each of the colors typically used in color printing, namely, cyan, magenta, yellow, and black (CMYK). A controller 324 generates timing signals for actuating the ink jet ejectors in the printheads 342A-342D in synchronization with the passage of the media to enable the four colors to be ejected with a reliable degree of accuracy for registration of the differently colored patterns to form four primary-color images on the media. The ink jet ejectors are actuated by the firing signals to correspond to image data processed by the controller 324 that may be transmitted to the printer, generated by a scanner (not shown) that is a component of the printer, or otherwise generated and delivered to the printer. In various possible embodiments, a color unit for each primary color may include one or more printheads; multiple printheads in a color unit may be formed into a single row or multiple row array; printheads of a multiple row array may be staggered; a printhead may print more than one color; or the printheads or portions of a color unit may be mounted movably in a direction transverse to the process direction, such as for spot-color applications and the like.

Each of color printheads 342A-342D may include at least one actuator configured to adjust the printheads in each of the printhead modules in the cross-process direction across the media web. In a typical embodiment, each motor is an electromechanical device such as a stepper motor or the like. In a practical embodiment, a print bar actuator is connected to a print bar containing two or more printheads and is configured to reposition the print bar by sliding the print bar along the cross-process axle of the media web. In alternative embodiments, an actuator system may be used that does not physically move the printheads but redirects the image data to different ejectors in each head to change head position.

The printer may use liquid ink or "phase-change ink," by which is meant that the ink is substantially solid at room temperature and substantially liquid when heated to a phase change ink melting temperature for jetting onto the imaging receiving surface. The phase change ink melting temperature may be any temperature that is capable of melting solid phase change ink into liquid or molten form. As used herein, liquid ink refers to melted solid ink, heated gel ink, or other known forms of ink, such as aqueous inks, ink emulsions, ink suspensions, ink solutions, or the like.

Associated with each color unit is a backing member, typically in the form of a bar or roll, which is arranged substantially opposite the color unit on the back side of the media. Each backing member is used to position the media at a predetermined distance from the printheads opposite the backing member. Each backing member may be configured to emit thermal energy to heat the media to a predetermined temperature.

Following the printing zone along the media path are one or more "mid-heaters" 344. A mid-heater 344 may use contact, radiant, conductive, and/or convective heat to control a temperature of the media and particularly to bring the media to a temperature suitable for desired properties when passing through the spreader 346. A fixing assembly in the form of the "spreader" 346 is configured to apply heat and/or pressure to the media to fix the images to the media. The function of the spreader 346 is to take what are essentially droplets, strings of droplets, or lines of ink on the sheet and smear them out by pressure and, in some systems, heat, so that spaces between adjacent drops are filled and image solids become uniform. The spreader 346 may include rollers, such as image-side roller 352 and pressure roller 350, to apply heat and pressure to the media, either of which can include heating elements, such as heating elements 348, to bring the media to a predetermined temperature. The spreader 346 may also include a cleaning/oiling station 354 associated with image-side roller 352. The station 354 cleans and/or applies a layer of some release agent or other material to the roller surface. A coating station 364 applies a clear ink to the printed media to modify the gloss and/or to help protect the printed media from smearing or other environmental degradation following removal from the printer.

Operation and control of the various subsystems, components and functions of the imaging system are performed with the aid of the controller 324. The controller 324 may be implemented with general or specialized programmable processors that execute programmed instructions. The controller 324 may be operatively coupled to the print bar and printhead actuators of color printheads 342A-342D in order to adjust the position of the print bars and printheads along the cross-process axle of the media web. In particular, the controller may be operable to shift one or more, or all, of the color units laterally or transverse to the process direction.

The imaging system may also include an optical imaging system 356 that is configured in a manner similar to that for creating the image to be transferred to the web. The optical imaging system is configured to detect, for example, the presence, intensity, and/or location of ink drops jetted onto the receiving member by the ink jets of the printhead assembly. The imaging system may incorporate a variety of light sources capable of illuminating the printed web sufficient to detect printing errors that may be attributable to a faulty or defective ink jet or printhead. The imaging system 356 further includes an array of light detectors or optical sensors that sense the image reflected from the printed web prior to discharge. The controller 324 analyzes the information from the imaging system 356 to determine, among other things, whether a failure or an ink jet or printhead has occurred. The location of the defective printing element is identified and made available to the maintenance technician during a diagnosis procedure. The controller 324 may also use the data obtained from the imaging system 356 to adjust the registration of the color units such as by moving a color unit or one or more printheads. This image data may also be used for color control.

FIG. 11 illustrates an inkjet or aqueous ink printer system 400 that is one of the printers 304, discussed above. Specifically, FIG. 11 illustrates a high-speed ink jet or aqueous ink image producing machine or printer 400. The printer 400 includes a media supply 410, a pretreatment unit 420, a printing unit 430, a dryer 440, and a sheet stacker 450. The media supply 410 stores a plurality of media sheets 412 for printing by the printer 400.

The pretreatment unit 420 includes at least one pretreatment device 422 and transport belt 424. The pretreatment unit 420 receives the media sheets from the media supply 410 and transports the media sheets in a process direction (block arrows in FIG. 11) through the pretreatment unit 420. The pretreatment device 422 conditions the media sheets and prepares the media sheets for printing in the printing unit 430. The pretreatment unit 420 may include, for example, a coating device that applies a coating to the media sheets, a drying device that dries the media sheets, and/or a heating device that heats the media sheets to a predetermined temperature. In some embodiments, the printer 400 does not include a pretreatment unit 420 and media sheets are fed directly from the media supply 410 to the printing unit 430. In other embodiments, the printer 400 may include more than one pretreatment unit.

The printing unit 430 includes at least one marking unit transport belt 432 that receives the media sheets from the pretreatment unit 420 or the media supply 410 and transports the media sheets through the printing unit 430. The printing unit 430 further includes at least one printhead (labeled CMYK in FIG. 11 to represent the standard cyan, magenta, yellow, and black color printheads; however any color printheads could be used). The printhead (CMYK) ejects aqueous ink onto the media sheets as the media sheets are transported through the printing unit 430. In the illustrated embodiment, the printing unit 430 includes four printheads (CMYK), each of which ejects one of cyan, magenta, yellow, and black ink onto the media sheets. The reader should appreciate, however, that other embodiments include other printhead arrangements, which may include more or fewer printheads, arrays of printheads, etc.

The dryer 440 includes a heater 442 and a vacuum drying belt 444 that receives the media sheets from the printing unit 430. A vacuum plenum 446 connects to a vacuum blower or the plumbing that is connected to a vacuum blower at one side in the cross-process direction. The sheet stacker 450 receives and stacks the printed sheets 452.

While FIGS. 10 and 11 illustrate four marking stations adjacent or in contact with a rotating belt, which is useful with systems that mark in four different colors such as, red, green, blue (RGB), and black; or cyan, magenta, yellow, and black (CMYK), as would be understood by those ordinarily skilled in the art, such devices could use a single marking station (e.g., black) or could use any number of marking stations (e.g., 2, 3, 5, 8, 11, etc.).

The print media is then transported by the sheet output transport 336 to output trays or a multi-function finishing station 334 performing different desired actions, such as stapling, hole-punching and C or Z-folding, a modular booklet maker, etc., although those ordinarily skilled in the art would understand that the finisher/output tray 334 could comprise any functional unit.

As would be understood by those ordinarily skilled in the art, the printing devices shown here are only examples and the systems and methods herein are equally applicable to other types of printing devices that may include fewer components or more components. For example, while a limited number of printing engines and paper paths are illustrated, those ordinarily skilled in the art would understand that many more paper paths and additional printing engines could be included within any printing device used with systems and methods herein.

Many computerized devices are discussed above. Computerized devices that include chip-based central processing units (CPU's), input/output devices (including graphic user interfaces (GUI), memories, comparators, tangible processors, etc.) are well-known and readily available devices produced by manufacturers such as Dell Computers, Round Rock TX, USA and Apple Computer Co., Cupertino CA, USA. Such computerized devices commonly include input/output devices, power supplies, tangible processors, electronic storage memories, wiring, etc., the details of which are omitted herefrom to allow the reader to focus on the salient aspects of the systems and methods described herein. Similarly, printers, copiers, scanners and other similar peripheral equipment are available from Xerox Corporation, Norwalk, CT, USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known and are not described in detail herein to keep this disclosure focused on the salient features presented. The systems and methods herein can encompass systems and methods that print in color, monochrome, or handle color or monochrome image data. All foregoing systems and methods are specifically applicable to electrostatographic and/or xerographic machines and/or processes.

In addition, terms such as "right", "left", "vertical", "horizontal", "top", "bottom", "upper", "lower", "under", "below", "underlying", "over", "overlying", "parallel", "perpendicular", etc., used herein are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements). Further, the terms automated or automatically mean that once a process is started (by a machine or a user), one or more machines perform the process without further input from any user. Additionally, terms such as "adapted to" mean that a device is specifically designed to have specialized internal or external components that automatically perform a specific operation or function at a specific point in the processing described herein, where such specialized components are physically shaped and positioned to perform the specified operation/function at the processing point indicated herein (potentially without any operator input or action). In the drawings herein, the same identification numeral identifies the same or similar item.

While some exemplary structures are illustrated in the attached drawings, those ordinarily skilled in the art would understand that the drawings are simplified schematic illustrations and that the claims presented below encompass many more features that are not illustrated (or potentially many less) but that are commonly utilized with such devices and systems. Therefore, Applicants do not intend for the claims presented below to be limited by the attached drawings, but instead the attached drawings are merely provided to illustrate a few ways in which the claimed features can be implemented.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. Unless specifically defined in a specific claim itself, steps or components of the systems and methods herein cannot be implied or imported from any above example as limitations to any particular order, number, position, size, shape, angle, color, or material.

What is claimed is:

1. An apparatus comprising:

a pair of opposing drive rollers;

a pair of opposing idle rollers, wherein axles of the drive rollers and the idle rollers are positioned along a circle, wherein the axles of the drive rollers and the idle rollers alternate along the circle; and a rotatable support operatively connected to the axles of the idle rollers, wherein rotation of the rotatable support moves the idle rollers along the circle until the idle rollers contact the drive rollers, wherein rotation of the rotatable support in a first direction relative to a frame of the apparatus causes a first idle roller to contact a first drive roller and a second idle roller to contact a second drive roller, wherein rotation of the rotatable support in a second direction opposite the first direction causes the first idle roller to contact the second drive roller and the second idle roller to contact the first drive roller, and wherein each of the idle rollers is positioned by the rotatable support to only contact a single drive roller at a time.

2. The apparatus according to claim 1, wherein the first idle roller spins in opposite directions when contacting the first drive roller or the second drive roller, and wherein the second idle roller spins in opposite directions when contacting the first drive roller or the second drive roller.

3. The apparatus according to claim 1, wherein contact between the first idle roller and the first drive roller forms a first drive nip, wherein contact between the second idle roller and the second drive roller forms a second drive nip, wherein contact between the first idle roller and the second drive roller forms a third drive nip, wherein contact between the second idle roller and the first drive roller forms a fourth drive nip, wherein the first drive nip and the second drive nip form a first sheet path, wherein the third drive nip and the fourth drive nip form a second sheet path, and wherein the first sheet path intersects the second sheet path.

4. The apparatus according to claim 3, wherein a pivot axis of the rotatable support is aligned with a sheet path intersection location where the first sheet path intersects the second sheet path.

5. The apparatus according to claim 1, further comprising at least one drive motor, wherein the drive rollers are connected to the drive motor to continuously rotate in opposite directions.

6. The apparatus according to claim 1, further comprising a rotation motor, wherein the rotatable support is connected to the rotation motor to pivot about a pivot axis upon operation of the rotation motor, and wherein the rotation motor is adapted to alternatively rotate the rotatable support in a clockwise direction or a counter-clockwise direction.

7. An apparatus comprising:

a frame;

drive rollers operatively connected to the frame;

a rotatable support operatively connected to the frame; and idle rollers operatively connected to the rotatable support, wherein the drive rollers and the idle rollers lie in the same plane, wherein a pivot axis of the rotatable support is centered between axles of the drive rollers and centered between axles of the idle rollers, wherein the axles of the drive rollers are in a fixed position relative to the frame and the axles of the idle rollers move relative to the drive rollers as the rotatable support rotates, wherein rotation of the rotatable support in a first direction relative to the frame causes a first idle roller to contact a first drive roller and a second idle roller to contact a second drive roller, and wherein rotation of the rotatable support in a second direction opposite the first direction causes the first idle roller to contact the second drive roller and the second idle roller to contact the first drive roller.

8. The apparatus according to claim 7, wherein the first idle roller spins in opposite directions when contacting the first drive roller or the second drive roller, and wherein the second idle roller spins in opposite directions when contacting the first drive roller or the second drive roller.

9. The apparatus according to claim 7, wherein contact between the first idle roller and the first drive roller forms a first drive nip, wherein contact between the second idle roller and the second drive roller forms a second drive nip, wherein contact between the first idle roller and the second drive roller forms a third drive nip, wherein contact between the second idle roller and the first drive roller forms a fourth drive nip, wherein the first drive nip and the second drive nip form a first sheet path, wherein the third drive nip and the fourth drive nip form a second sheet path, and wherein the first sheet path intersects the second sheet path.

10. The apparatus according to claim 9, wherein the pivot axis is aligned with a sheet path intersection location where the first sheet path intersects the second sheet path.

11. The apparatus according to claim 7, further comprising at least one drive motor operatively connected to the frame, wherein the drive rollers are connected to the drive motor to continuously rotate in opposite directions.

12. The apparatus according to claim 7, further comprising a rotation motor operatively connected to the frame, wherein the rotatable support is connected to the rotation motor to pivot about the pivot axis upon operation of the rotation motor, and wherein the rotation motor is adapted to alternatively rotate the rotatable support in a clockwise direction or a counter-clockwise direction.

13. A sheet transport device comprising:

a frame;

sheet transport paths operatively connected to the frame; and a path intersection nip driver positioned at an intersection of two of the sheet transport paths, wherein the path intersection nip driver comprises:

drive rollers operatively connected to the frame;

a rotatable support operatively connected to the frame; and idle rollers operatively connected to the rotatable support, wherein the drive rollers and the idle rollers lie in the same plane, wherein a pivot axis of the rotatable support is centered between axles of the drive rollers and centered between axles of the idle rollers, wherein the axles of the drive rollers are in a fixed position relative to the frame and the axles of the idle rollers move relative to the drive rollers as the rotatable support rotates, wherein rotation of the rotatable support in a first direction relative to the frame causes a first idle roller to contact a first drive roller and a second idle roller to contact a second drive roller, and wherein rotation of the rotatable support in a second direction opposite the first direction causes the first idle roller to contact the second drive roller and the second idle roller to contact the first drive roller.

14. The sheet transport device according to claim 13, wherein the first idle roller spins in opposite directions when contacting the first drive roller or the second drive roller, and wherein the second idle roller spins in opposite directions when contacting the first drive roller or the second drive roller.

15. The sheet transport device according to claim 13, wherein contact between the first idle roller and the first drive roller forms a first drive nip, wherein contact between the second idle roller and the second drive roller forms a second drive nip, wherein contact between the first idle roller and the second drive roller forms a third drive nip, wherein contact between the second idle roller and the first drive roller forms a fourth drive nip, wherein the first drive nip and the second drive nip form a first sheet path, wherein the third drive nip and the fourth drive nip form a second sheet path, and wherein the first sheet path intersects the second sheet path.

16. The sheet transport device according to claim 15, wherein the pivot axis is aligned with a sheet path intersection location where the first sheet path intersects the second sheet path.

17. The sheet transport device according to claim 13, further comprising:

at least one drive motor operatively connected to the frame, wherein the drive rollers are connected to the drive motor to continuously rotate in opposite directions; and a rotation motor operatively connected to the frame, wherein the rotatable support is connected to the rotation motor to pivot about the pivot axis upon operation of the rotation motor, and wherein the rotation motor is adapted to alternatively rotate the rotatable support in a clockwise direction or a counter-clockwise direction.

* * * * *